US007056137B1

(12) United States Patent
Vall Gendre et al.

(10) Patent No.: US 7,056,137 B1
(45) Date of Patent: Jun. 6, 2006

(54) ELECTRICAL CONNECTORS HAVING A SEALING ELEMENT

(75) Inventors: Gerard Vall Gendre, Valls (ES); Josep Maria Roset Rubio, Valls (ES)

(73) Assignee: Lear Corporation, Southfield, MI (US)

( * ) Notice: Subject to any disclaimer, the term of this patent is extended or adjusted under 35 U.S.C. 154(b) by 0 days.

(21) Appl. No.: 10/904,374

(22) Filed: Feb. 28, 2005

(51) Int. Cl.
*H01R 13/52* (2006.01)

(52) U.S. Cl. ..... 439/271; 439/76.1

(58) Field of Classification Search ..... 439/76.1, 439/271, 272, 273, 274, 275
See application file for complete search history.

(56) References Cited

U.S. PATENT DOCUMENTS 4,959,018 A * 9/1990 Yamamoto et al. ..... 439/76.1
6,071,147 A * 6/2000 Tsukamoto ..... 439/587
6,155,850 A * 12/2000 Martin et al. ..... 439/157
6,210,191 B1 * 4/2001 Sai ..... 439/274
6,547,581 B1 * 4/2003 Zweigle et al. ..... 439/271
6,551,124 B1 * 4/2003 Gossmann ..... 439/411

* cited by examiner

*Primary Examiner*—Chandrika Prasad
(74) *Attorney, Agent, or Firm*—Bruce E. Harang

(57) ABSTRACT

Provided for connectors intended for being coupled to a housing (1) defined in an electric junction box, with male terminals projecting from the bottom thereof and wherein between the body (9) of the connector and the bottom of the housing (1), a leak-tight seal (12) is arranged, the invention consists of situating between said seal (12) and the bottom of the housing (1), a separator (3) traversed by said male terminals, on which separator said seal (12) is in turn assembled, having die cuts (13) for said terminals and with slits (14) and (15) for pins (5) and (6) projecting from the plate (3) of the separator and which can be coupled inside the body (9), such that in the tightening of these elements, a deformation of the seal (12) is achieved against the separator (3), and accordingly with regard to the bottom of the housing (1), as well as with regard to the side wall of the latter, quite considerably facilitating the assembly of the seal (12), as this can be carried out on the stiff element constituted of the separator, outside of the housing (1), and the subsequent assembly of said ensemble inside the latter.

3 Claims, 2 Drawing Sheets

ELECTRICAL CONNECTORS HAVING A SEALING ELEMENT

OBJECT OF THE INVENTION

The present invention refers to a special arrangement for the sealing means of an electric connector, especially of a connector of those used in the automotive field, specifically in the electric circuits of automotive vehicles.

The object of the invention is to achieve improving the sealing conditions, i.e. the leak-tightness conditions, with a multipurpose character since said sealing is achieved at both a frontal and perimetrical level of the connector.

BACKGROUND OF THE INVENTION

In the preferred field of practical application of the invention, the previously mentioned automotive field, electric connectors associated to boxes containing circuits are used, such that in said boxes, one or more housings are defined for respective connectors, male connection pins or terminals being arranged at the bottom of said housings, being able to receive respective female terminals arranged in the connector itself.

To achieve leak-tightness, a seal is arranged at the bottom of said housing which must be traversed by the male terminals projecting from the bottom of the housing, with a sufficient tightening so as to assure leak-tightness, this assembly being complemented with a separator materialized in a stiff plate resting on said seal, having slits for the passage of the terminals of the housing and having pins for the tongue and groove coupling of the body of the terminal.

This structure implies assembly problems, since the perfect dimensional tightening which must exist between the seal and the internal perimeter of the housing creates problems for the insertion of said seal, being necessary to exert force to break it in the areas in contact with the housings of the terminal, while the peripheral sealings require a force in order to be inserted around the body, problems for handling thereby existing due to the packing.

DESCRIPTION OF THE INVENTION

The sealing arrangement proposed by the invention solves in a fully satisfactory manner the drawbacks set forth above.

To that end and more specifically, the indispensable seal assuring the leak-tightness is not arranged at the bottom of the housing, as is conventional, but rather arranged at said bottom is said separator on which the seal is in turn arranged.

To that end, said seal incorporates, in addition to the slits intended for the passage of the male terminals of the housing, other slits coinciding in shape, size, and position with the pins of the separator to carry out a pre-assembly of the seal on the latter, and the subsequent assembly of the ensemble at the bottom of the housing.

Furthermore, said separator incorporates, as a complement of the two notched and classic pins acting as retention means for the body of the terminal, two other pins acting as side stops for the female terminals of the body, preventing unwanted deformations therein when the male terminals of the housing are inserted therein.

It is thus achieved that the seal is quickly and easily assembled, with no problems of insertion, that the watertight properties are controlled at all times, since the pressure of the seal is carried out with the spacer, such that if this element is well closed, protection against water is assured, and the general performances of the device are substantially enhanced.

DESCRIPTION OF THE DRAWINGS

To complement the description being made and for the purpose of better understanding the features of the invention, according to a practical embodiment example thereof, a set of drawings is attached as an integral part of said description, in which drawings the following has been shown with an illustrative and non-limiting character.

PREFERRED EMBODIMENT OF THE INVENTION

Figure 1:
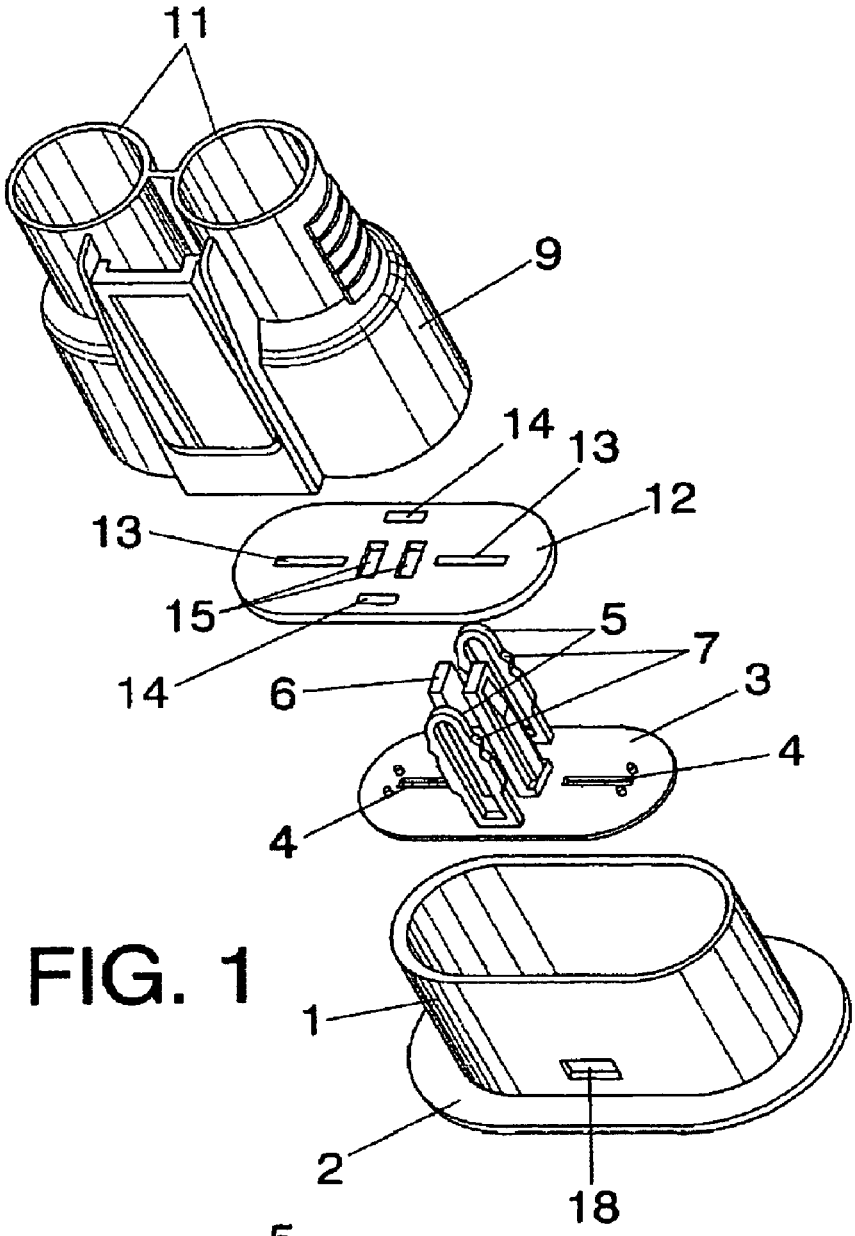
FIG. 1 shows an exploded perspective view of an electric connector carried out according to the sealing arrangement constituting the object of the present invention.

In the Figures mentioned, the housing of the connector is given reference number (1), materialized as a type of cup which, in FIG. 1, is shown with a perimetrical expansion (2) at the bottom, but in practice, said expansion will be part of the electric junction box which said housing (1) is intended to form a part of, and through which bottom the male receptor pins or terminals (19) of the connector itself project and are duly associated to the electronic circuit or circuits housed in said box.

At the bottom of housing (1), a separator plate (3) is situated, the contour of which coincides in shape and size with the internal section of the housing (1), said separator plate (3) having a pair of slits (4) suitable in size and position for allowing the passage therethrough of said pins or terminals (19) arranged at the bottom of the housing (1).

Figure 3:
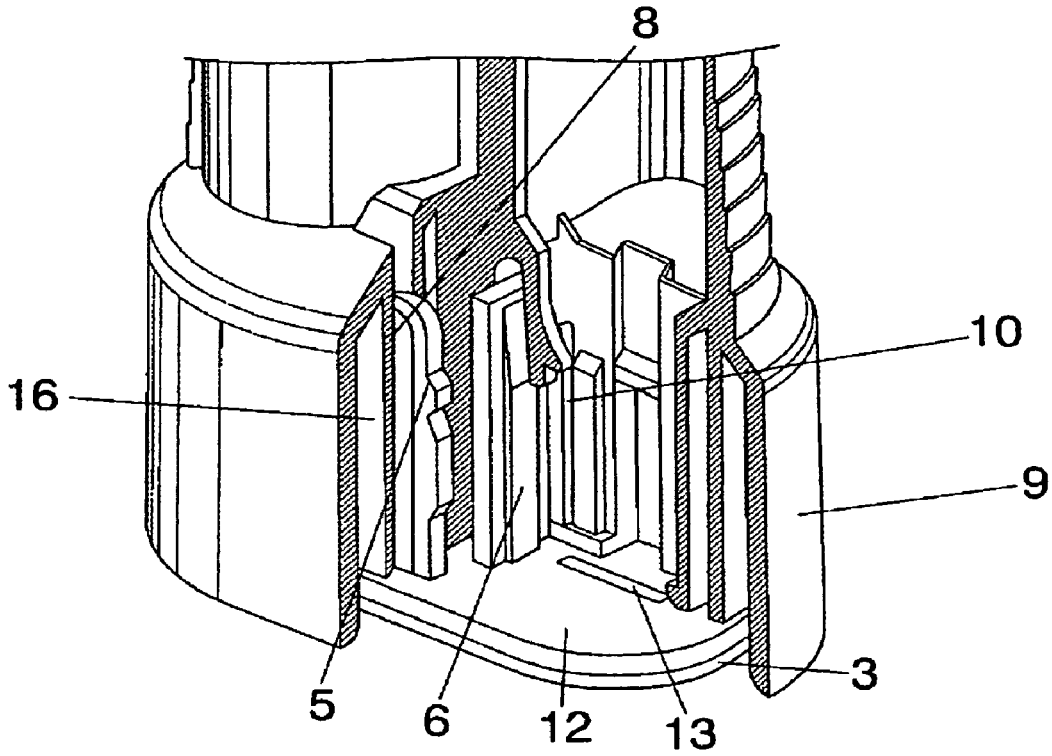
FIG. 3 shows a partially sectioned perspective view of the body of the connector and of the ensemble constituted of the seal and the separator.
Figure 4:
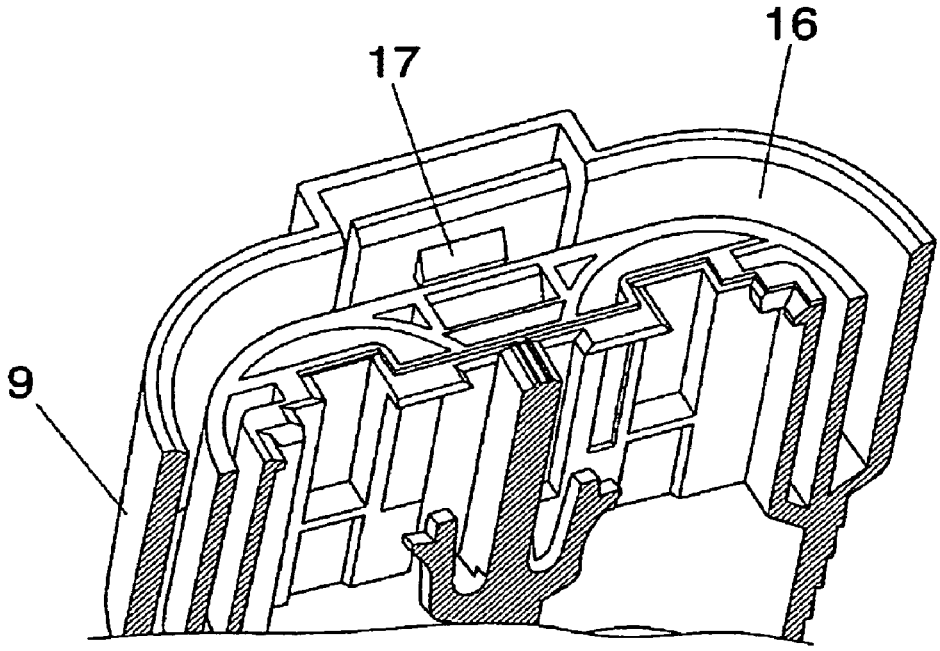
FIG. 4 finally shows a perspective and cross sectional view of a partial detail of the body of the connector.

Two pairs of pins (5) and (6), symmetrical and in twos, perpendicularly project from the upper side of the separator plate (3), pins (5) are hollow, their side edges (7) are notched and intended for being coupled, by means of elastic deformation, with slits (8) operatively arranged on the body (9) of the connector, as especially seen in FIG. 3.

The other pair of pins (6) is in turn intended for being located in the slits or housings of the body (9) for the female terminals (10) of the connector itself, preventing unwanted deformations in said terminals, especially due to tensile stresses that the body (9) of the connector may undergo and which could generate the accidental disconnection thereof.

The body (9) of the connector incorporates two cylindrical necks* (11) for the passage of respective wires, which are completely independent inside the connector.

Figure 2:
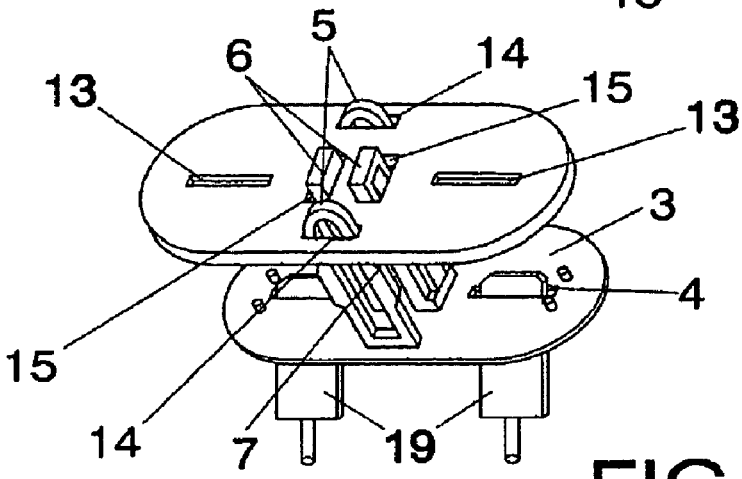
FIG. 2 also shows a perspective view of a detail of the ensemble constituted of the seal and the separator, in an intermediate coupling phase of these elements.

The seal (12), constituent of the leak-tightening element of the ensemble, incorporates a pair of die cuts (13) for the passage of the male pins or terminals (19) projecting from the bottom of the housing (1), and since it is intended for being assembled on the separator plate (3), as shown in FIG. 2, it incorporates a pair of slits (14) for the pins (5) and another pair of slits (15) for the pins (6), through which said pins pass in a perfectly tight manner.

The side wall of the housing (1) is intended for being housed in a perimetrical slit (16) of the body (9), and the axial fixing or retention between these elements is determined by the existence of notches (17) on said perimetrical slit (16), which are tongue and groove coupled, in an assembly limit position, in recesses (18) of the housing (1).

The invention claimed is:

1. Sealed electrical connectors for coupling in housings operatively arranged in electric circuit boxes, particularly electrical connectors used in the automotive field having a seal positioned on a separator plate between a connector body and a connector body housing comprising:

a housing (1) having a pair of recesses (18) for attaching a connector body (9) operatively arranged in an electric circuit box;

a separator plate (3) having a upper side and a lower side operatively arranged in said housing (1), having a first pair of pins (5) and a second pair of pins (6) projecting from said upper side of said separator plate (3), and also having a pair of slits (4) suitably sized to allow passage of male terminals (19);

a leak-tightness seal (12) operatively arranged on said upper surface of said separator plate (3) having a first pair of die cut openings (14) arranged to allow passage of said first pair of pins (5) therethrough, a second pair of die cut openings (15) arranged to allow passage of said second pair of pins (6) therethrough, and a pair of die cut openings (13) cooperatively arranged with said pair of slits (4) of said separator plate (3) allowing passage of male terminals (19) forming a seal around said openings (13, 14, 15) and between said separator plate (3) and said connector body (9); and the connector body (9) having a first end having a pair of cylindrical necks (11) for introducing electrical wires to female connectors (10), and having a second end having perimetrical slit (16) for mounting housing (1), a pair of slits (8) for mounting said first pair of pins (5) and a pair of retention notches (17) cooperatively arranged to mount in said recesses (18) of housing (1).

2. Sealed electrical connectors according to claim 1, characterized in that said first pairs of pins (5) is hollow and has notched side edges allowing pressure-coupling thereof in respective housings or said slits (8) of said connector body (9), and said second pair of pins (6) acts laterally on said female terminals (10) of said connector body (9), preventing deformations of said female terminals (10) and accidental disconnection.

3. Sealed electrical connectors according to claim 1, characterized in that said connector body (9) incorporates a deep perimetrical slit (16) in which said housing (1) completely penetrates in the coupled position, said connector body (9) and said housing (1) being fixed by means of retention notches (17) in said perimetrical slit (16), and complementary recesses (18) in said housing (1).

* * * * *